US005979736A

United States Patent [19]

Edeholt

[11] Patent Number: 5,979,736

[45] Date of Patent: Nov. 9, 1999

[54] HAND TOOL HAVING RECIPROCATING OPERATING MEMBER

[75] Inventor: Håkan Edeholt, Stockholm, Sweden

[73] Assignee: Isaberg Rapid AB, Hestra, Sweden

[21] Appl. No.: 08/952,783

[22] PCT Filed: May 15, 1996

[86] PCT No.: PCT/SE96/00633

§ 371 Date: Nov. 26, 1997

§ 102(e) Date: Nov. 26, 1997

[87] PCT Pub. No.: WO96/38267

PCT Pub. Date: Dec. 5, 1996

[30] Foreign Application Priority Data

May 30, 1995 [SE] Sweden ..... 9501965

[51] Int. Cl.[6] ..... B25C 1/00; B25C 5/06

[52] U.S. Cl. ..... 227/132

[58] Field of Search ..... 227/132, 134

[56] References Cited

U.S. PATENT DOCUMENTS

| | | | |
|---|---|---|---|
| 2,471,764 | 4/1949 | Kniff | 227/132 |
| 2,746,043 | 5/1956 | Heller | 227/132 |
| 2,769,174 | 11/1956 | Libert . | |
| 4,126,260 | 11/1978 | Mickelsson | 227/132 |
| 4,225,075 | 9/1980 | Chi | 227/132 |
| 5,427,299 | 6/1995 | Marks | 227/132 |

FOREIGN PATENT DOCUMENTS

| | | |
|---|---|---|
| 0 254 775 | 2/1988 | European Pat. Off. . |
| 0 281 541 | 9/1988 | European Pat. Off. . |
| 2 145 764 | 2/1973 | France . |
| 30 48 465 | 9/1981 | Germany . |

*Primary Examiner*—Jessica J. Harrison
*Assistant Examiner*—John Paradiso
*Attorney, Agent, or Firm*—Shapiro and Shapiro

[57] ABSTRACT

A hand tool comprises a body (2), a handle member (3) pivotally mounted thereon and an operating member (4) which is displaceable relative to the body between a starting position and a turning position against the action of a force. The handle member (3) comprises an elbow lever element (10) which has a pivot pin (14) resting against a support (15) arranged in the body (2) and which is displaceable along the support perpendicular to the pivot pin (14). The elbow lever element (10) has a first arm (10') which is pivotable about the pivot pin (14) towards and away from the body (2), and a second arm (10") which is adapted to engage the operating member (4) when the first arm (10') pivots in the direction of the body (2) and to move the operating member from the starting position to the turning position against the action of said force. The handle member (3) is arranged such that the elbow lever element (10), when the first arm (10') pivots in the direction of the body (2), on the one hand is pivoted about the pivot pin (14) and, on the other hand, is moved in the direction of the operating member (4) while the pivot pin rests against the support (15), whereby the moment arm (L1, L2) of the first and second arm (10', 10") perpendicular to the direction of displacement of the operating member (4) gets longer and shorter, respectively.

16 Claims, 5 Drawing Sheets

Power
Hand power (strong person)
Hand power (person of medium strength)
Hand power (weak person)
Required pressing-down power (inventive stapler)
Required pressing-down power (prior-art stapler)
V1
V Degree of utilisation (%)
100
50
Prior-art stapler (person of medium strength)
Inventive stapler (person of medium strength)
V1
V

HAND TOOL HAVING RECIPROCATING OPERATING MEMBER

BACKGROUND OF THE INVENTION

1. Field of the Invention

The present invention relates to a hand tool comprising a body, a handle member pivotally mounted thereon and an operating member which is displaceable relative to the body between a starting position and a changeover position (where the motion of the driver changes from a lifting motion to a downward), striking motion, the displacement of the operating member from the starting position to the turning position, during use of the tool, taking place against the action of a force that increases during at least part of said displacement, and the handle member being arranged to engage the operating member so as to displace, when pivoting relative to the body, the operating member from the starting position to the changeover position.

2. Related Background Art

An example of a known hand tool of this type is disclosed in Swedish Patent Specification 8700892-6. This prior-art tool is a stapler for driving staples into an object. The operating member of the tool is a driver which engages a leaf spring and is adapted, while being displaced from a lower starting position to an upper changeover position, to tension this spring, which then produces the force counteracting the displacement. The stapler has in its lower portion a magazine which contains a horizontal row of releasably interconnected staples, which are urged forward towards a firing position in the front portion of the stapler by a spring-loaded feeding mechanism. When the driver reaches its changeover position, it is released, the spring giving the driver a striking motion starting from the changeover position in order to drive the front staple located in the firing position into an object.

The handle member of the prior-art stapler is a straight lever. The lever is pivoted to the body of the stapler by means of a horizontal pivot pin and has a short front arm and a long rear arm, which constitutes the handle of the stapler. The front arm of the lever engages by its front end in a hole in the upper portion of the driver so as to raise the driver from the starting position to the changeover position against the action of the spring when the handle, i.e. the rear arm of the lever, is urged downwards towards the body of the stapler. The lever is designed in such a manner that the front end of its front arm is moved out of the hole in the upper portion of the driver when the driver reaches the changeover position. Then the driver is released to perform its striking motion.

A recess extends transversely through the body of the stapler and is defined in its upper part by a gripping surface. The handle is to be pressed downwards by hand. The thumb of one hand is placed across the handle and the other fingers of the same hand are inserted into the recess in the body, whereupon one presses the handle downwards by making a squeezing motion with the thumb pressed against the handle and the other fingers pressed against the gripping surface. In the starting position, the handle extends obliquely upwardly and rearwardly, the opening angle being relatively great. This results in an initial state where the grasping opening of the hand (the amount that the hand must be open to grasp the tool), corresponding to the distance between the upper side of the handle and the gripping surface, is large. The grasping opening of the hand decreases during the squeezing motion and is comparatively small when the handle reaches a substantially horizontal position, in which the driver is located in its upper changeover position.

The maximum squeezing power of the hand, which henceforth is called the hand power, is relatively small in a large grasping opening as well as in a small grasping opening and is at its maximum in an intermediate grasping opening position. In the starting position of the handle, the hand power thus is fairly small and to during squeezing, i.e. with a decreasing grasping opening, will first increase to a maximum in the intermediate grasping opening position and, as the squeezing continues from this intermediate position, decrease again.

The condition described above is illustrated in FIG. 1, which is a diagram, in which the hand power as a function of the angle v for the pivoting of the handle from the starting position is shown for three persons having different strength. FIG. 1 also shows the pressing-down power which is necessary for pressing down the handle and which is proportional to the counterforce produced by the leaf spring, as a function of the angle v in the angular area between v=0 (starting position of the handle) and $v=v_1$. The angle $v_1$ corresponds to the horizontal position of the handle, in which the driver is located in its upper changeover position. FIG. 1 thus illustrates both the available hand power and the required pressing-down power. The spring force and, thus, the required pressing-down power increase linearly relative to the pivoting angle, whereas the hand power, as described above, first increases so as to later decrease. As is evident from the shown example, the weakest person does not have sufficient hand power to press down the handle, whereas the strongest person manages this relatively easily.

FIG. 2 shows the ratio (in percent) of the required pressing-down power to the hand power of the person of medium strength as a function of the pivoting angle v for the example shown in FIG. 1. As is evident, the person of medium strength first needs to use but a minor amount of the available hand power when pressing down the handle. Then he must gradually use a greater and greater amount of the available hand power so as to use, at the end, almost 100% thereof. Of course, this is strenuous work and also has the drawback that the precision, i.e. the ability to hold the stapler in the exactly correct position, is considerably deteriorated at the actual firing moment. Therefore a more uniform utilisation of the available hand power is desirable.

SUMMARY OF THE INVENTION

A special object of the present invention therefore is to provide a stapler, in which the curve of the power required for pressing down the handle of the stapler corresponds more closely to the curve of the available hand power in such a manner that a more uniform degree of utilisation with respect to the available hand power should be obtainable through the pivoting area of the handle.

A more general object of the present invention is to provide a tool of the type mentioned by way of introduction, in which the power required for pivoting the handle member is, in a simpler manner, adapted to the available hand power in the manner described above.

The general object is achieved by a hand tool comprising a body, a handle member pivotally mounted on the body, and an operating member which is displaceable between a starting position and a changeover position, the displacement of the operating member from the starting position to the changeover position, during use of the tool, taking place against the action of a force that increases during at least part of the displacement, and the handle member being arranged to engage the operating member so as to displace, when pivoting relative to the body, the operating member from the starting position to the changeover position.

The handle member of the hand tool comprises an elbow lever element, which has a pivot pin resting on a support arranged in the body and which is displaceable relative to the support transversely to an axis of the pivot pin, the elbow lever element having a first arm which is pivotable about the pivot pin toward and away from a portion of the body, and a second arm which is angled relative to the first arm and extends from the pivot pin toward the operating member to engage the operating member when the first arm pivots toward the portion of the body, and to move the operating member from the starting position to the changeover position against the action of the force.

The arrangement of the handle member is such that the pivot pin, when the first arm pivots toward the portion of the body, moves toward the operating member while the pivot pin rests on the support, whereby moment arms of the first and the second arms perpendicular to a direction of displacement of the operating member become longer and shorter, respectively.

BRIEF DESCRIPTION OF THE DRAWINGS

The invention will now be described in relation to preferred embodiments thereof and with reference to the accompanying drawings, in which.

DESCRIPTION OF THE PREFERRED EMBODIMENTS

Figure 5:
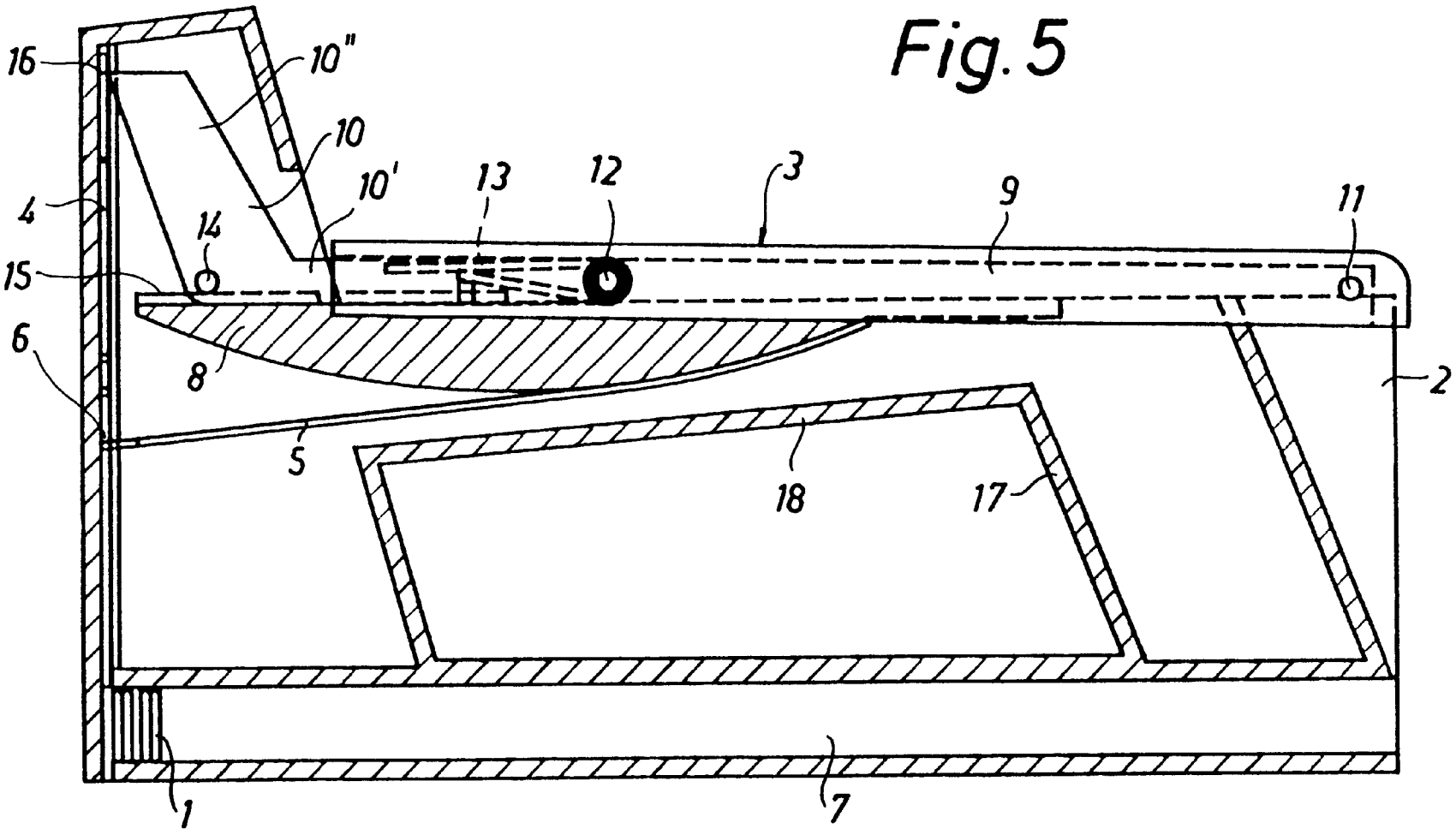

The hand tool shown in FIGS. 3–6 is a stapler for driving staples 1 into an object (not shown). Basically, this stapler is of the same type as the prior-art stapler described by way of introduction. The inventive stapler thus comprises a body 2, a handle member 3 pivotally mounted thereon, and a driver 4 arranged in the front portion of the body 2 and adapted to drive the staples 1 one by one into an object. The driver 4 is vertically displaceable relative to the body 2 between a lower starting position (FIGS. 3 and 6) and an upper changeover position (FIG. 5). A leaf spring 5, which extends in the longitudinal direction of the stapler, is at its rear end fixedly attached to the body 2 and engages at its front end into a lower hole 6 in the driver 4. The lower portion of the stapler accommodates a magazine 7, which contains a horizontal row of releasably interconnected staples 1 which are urged forward towards a firing position in the front portion of the stapler, by a spring-loaded feeding mechanism (not shown).

The driver 4 is raised from its lower starting position to its upper changeover position by means of the handle member 3, the spring 5 being tensioned while being bent upwards about the arcuate underside of a support member 8 fixedly arranged in the body 2. When the driver 4 reaches its upper changeover position, it is released. The spring 5 then imparts to the driver 4 a striking motion starting from the upper changeover position in order to drive the front staple 1 located in the firing position into an object.

It should be noted that "front", "rear", "upper", "lower", "horizontal" and "vertical" as stated above and also henceforth are used with respect to the position in which the hand tool is shown in the drawings. It will be appreciated that the shown horizontal position is only one of many feasible positions of use of the tool.

The handle member 3 consists of a handle 9 and an elbow lever element 10. The handle 9 is designed as a straight arm, whose cross-section is in the shape of an inverted U. The handle 9 is at its rear end pivotally connected to the body 2 in the rear portion thereof by means of a pivot pin 11 defining a horizontal pivot axis. The elbow lever element 10 has a first arm 10' and, angled thereto, a second arm 10". The angle $\alpha$ between the two arms 10' and 10", which suitably is 90°–130°, is about 120° in the embodiment illustrated. In the starting position of the handle member 3 (FIGS. 3 and 6), the first arm 10' extends obliquely upwards-backwards and the second arm 10" extends obliquely upwards-forwards. Each of the two arms 10" and 10' is, like the handle 9, an inverted U in cross-section, this U being of such a width that the first arm 10' can be received in the handle 9. The first arm 10' of the elbow lever element 10 is, at its rear end, turnably connected to the handle 9' at a location behind the free front end thereof, by means of a turning pin 12 extending in parallel with the pivot pin 11. A spring 13 engages the first arm 10' and the handle 9 so as to urge them to the starting position shown in FIGS. 3 and 6.

A support and pivot pin 14 extending in parallel with the pins 11 and 12, extends through the elbow lever element 10 in the angular portion thereof. The pin 14 rests against a horizontal support surface 15 which is formed on the upper side of the stationary support member 8. When pivoting about the pin 14, the elbow lever element 10 is movable back and forth along the support surface 15 between a rear position (the starting position shown in FIGS. 3 and 6) and a front position or firing position (FIG. 5).

Figure 3:
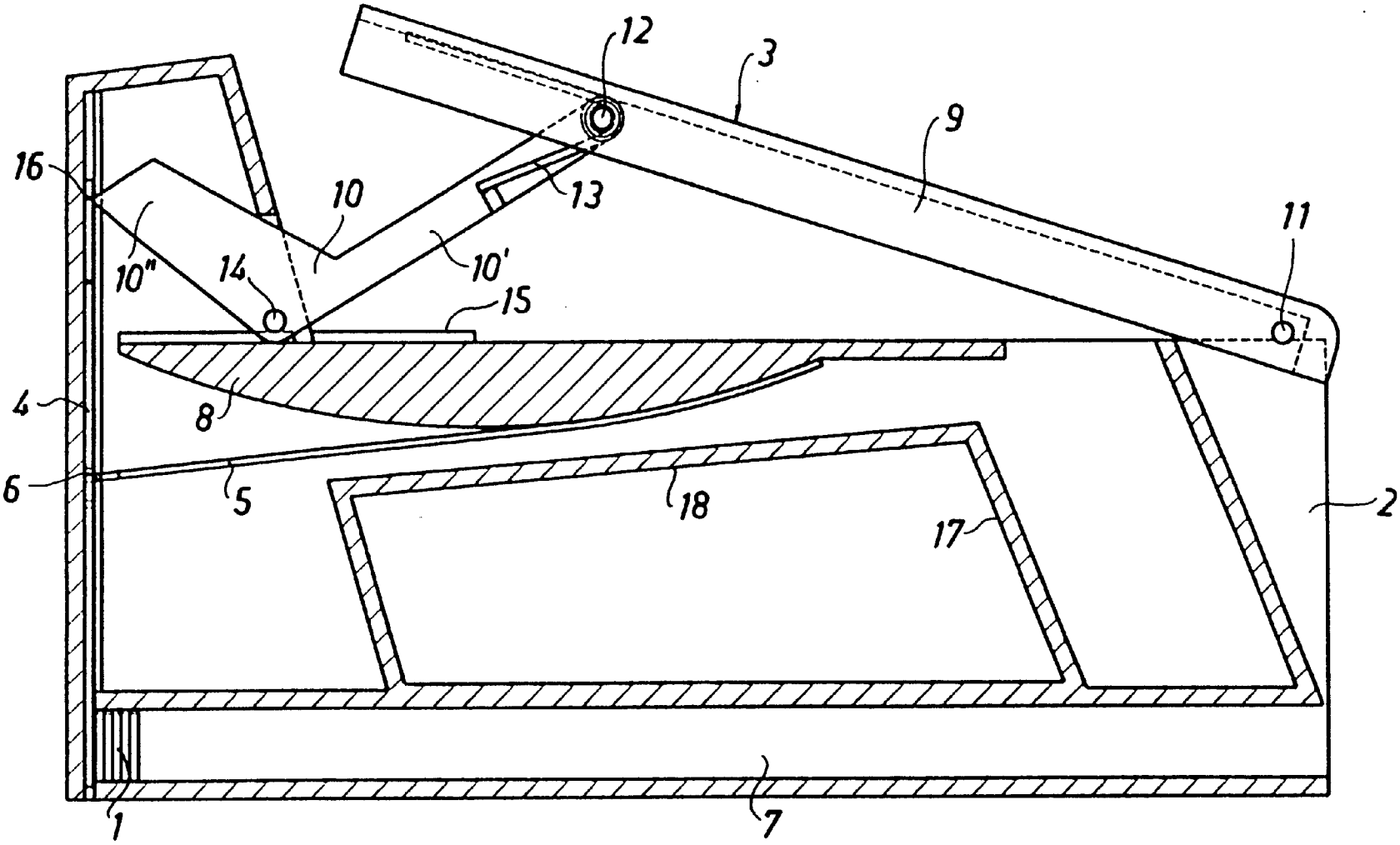
FIG. 3 is a part-sectional side view and shows a hand tool according to the present invention, the handle of the tool being in a starting position.
Figure 4:
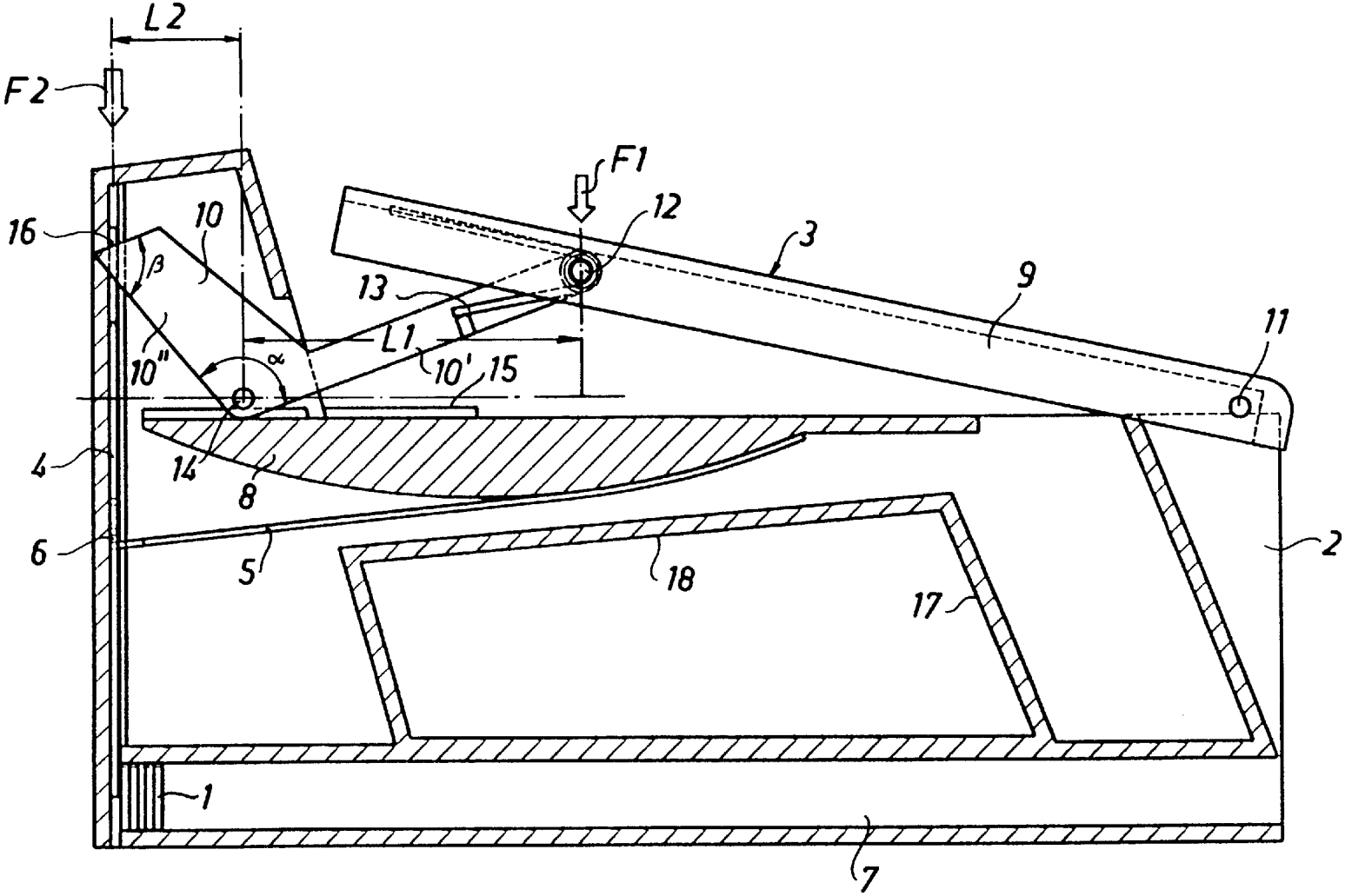
FIGS. 4 and 5 correspond to FIG. 3 but show the handle of the tool in an intermediate position and a pressed-down position.
Figure 6:
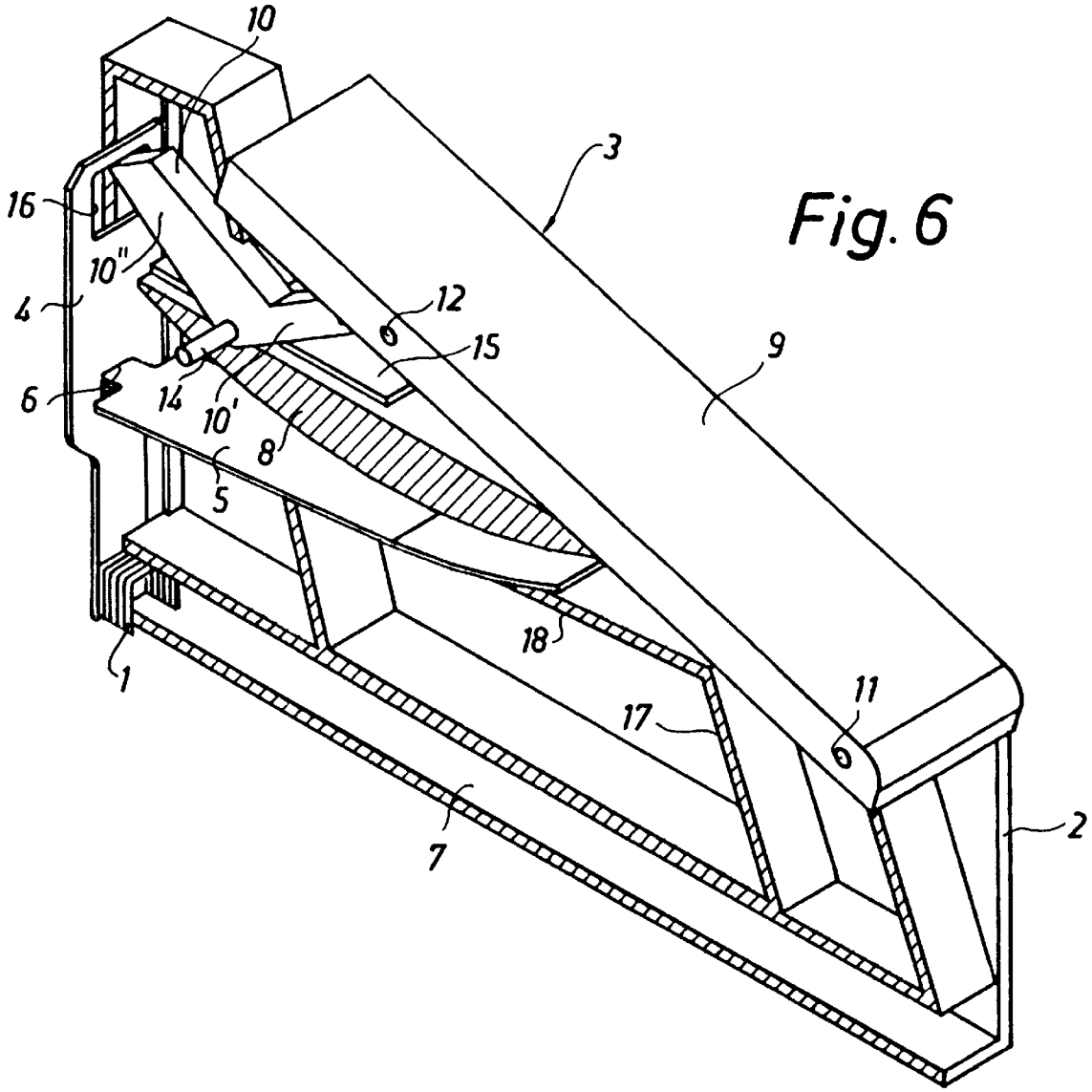
FIG. 6 is a part-sectional perspective view and shows the handle of the tool in the starting position.

The front end or nose of the second arm 10" of the elbow lever element 10 engages an upper hole 16 in the driver 4 so as to raise the driver from its starting position to its upper changeover position when the handle 9 is pivoted from the starting position shown in FIGS. 3 and 6 to the horizontal position shown in FIG. 5. When the driver 4 reaches its upper changeover position, the elbow lever element 10 reaches its front position or firing position, and the front end of the second arm 10" is pivoted out of the upper hole 16 in the driver 4, thereby releasing the driver, which is fired by the tensioned leaf spring 5.

A recess 17 extends transversely through the body 2 and is defined in its upper part by a downwardly facing gripping surface 18. The handle 9 should be pressed downwards by hand in the same way as in the known stapler described above, the thumb of one hand is placed across the handle 9 and the other fingers of the same hand are inserted into the recess 17, where-upon one presses the handle 9 downwards by making a squeezing motion with the thumb pressed against the handle and the other fingers pressed against the gripping surface 18.

In this squeezing motion, the handle 9 is pivoted counterclockwise about the pivot pin 11, which is fixed relative to the body 2, and the elbow lever element 10 is pivoted clockwise about the pivot pin 14, while the pivot pin 14 and the elbow lever element 10 are moved forward along the support surface 15. While the handle 9 is pressed down, the driver 4 is raised from its starting position to its upper changeover position, which takes place against the force of the leaf spring 5, which increases as the driver 4 is raised and, thus, the leaf spring is bent.

The power by which the handle 9 is to be pressed down, i.e. the necessary pressing-down power, consists of the force produced by the leaf spring 5, exchanged via the elbow lever element 10, plus the counterforce which is produced by the spring 13 and which may, however, be ignored as compared with the exchanged force of the leaf spring. The moment arm of the first arm 10' perpendicular to the direction of displacement of the driver 4, i.e. its horizontal moment arm, is designated L1 in FIG. 4. The corresponding moment arm of the second arm 10" is designated L2 in FIG. 4. For the pressing-down power F1 (FIG. 4) which is necessary for pressing down the handle 9, if the action of the spring 13 is ignored, $F1=F2 \cdot L2/L1$, wherein F2 is the spring force produced by the leaf spring 5. Since in the embodiment shown L1 is greater than L2 in all the pivoting positions of the elbow lever element 10 between the starting position shown in FIGS. 3 and 6 and the position shown in FIG. 5, the elbow lever element 10 changes down the leaf spring force F2, i.e. $F1<F2$. As the handle 9 is pressed downwards and the elbow lever element 10 is thus pivoted clockwise and is displaced forwards, the moment arm L1 will be longer, while the moment arm L2 will be shorter, i.e. the changing-down ratio increases.

Figure 1:
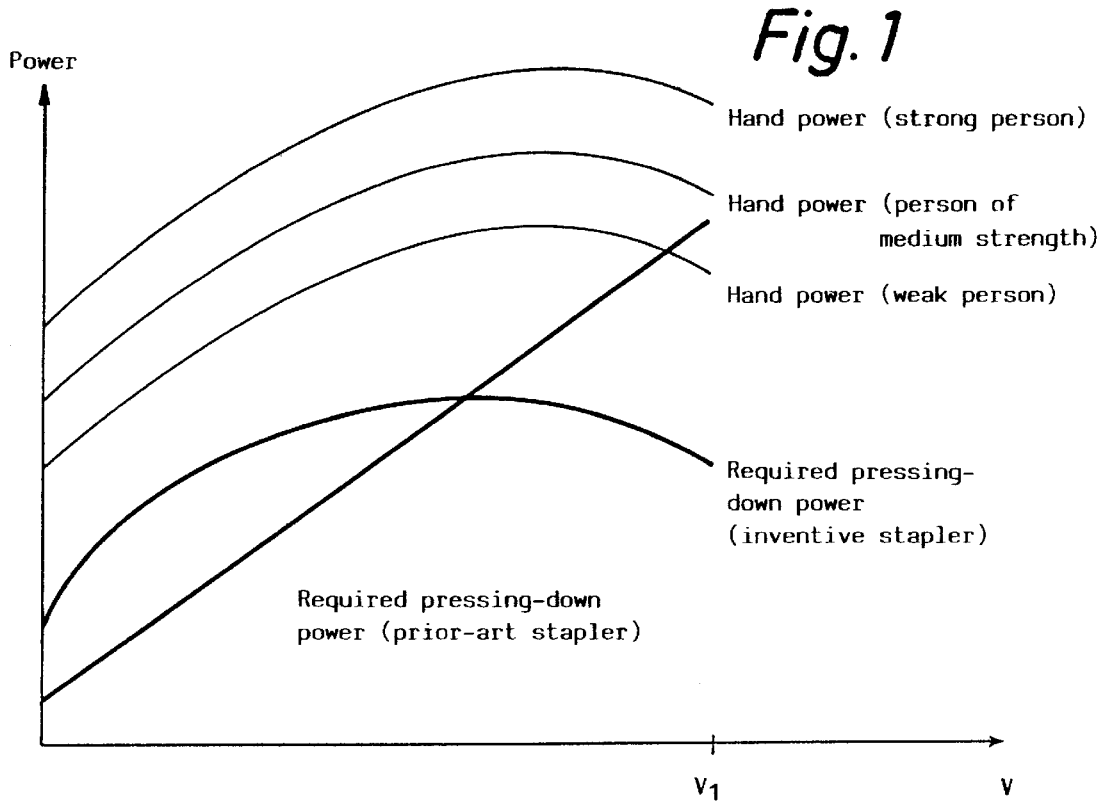
FIG. 1 is a diagram of power, which shows the available hand power and the necessary pressing-down power as a function of the pivoting angle of a pivotable tool handle.
Figure 2:
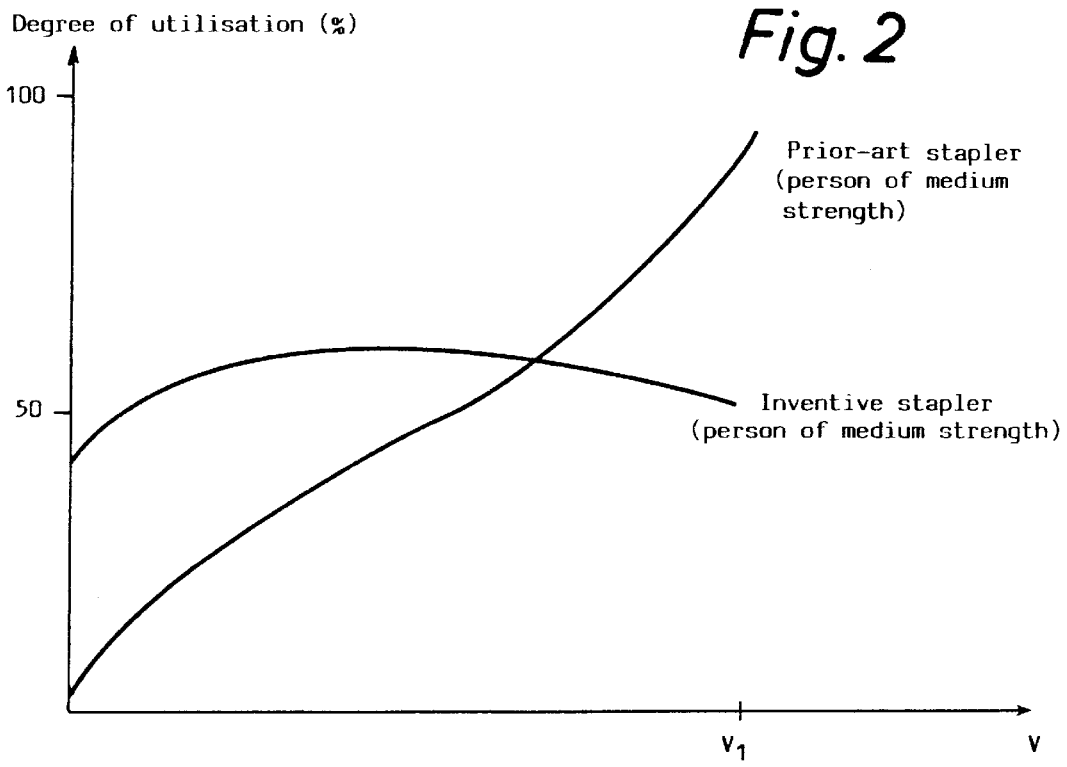
FIG. 2 is a diagram showing the ratio of the necessary pressing-down power to the available hand power as a function of the pivoting angle.

By selecting a suitable length and angular setting $\alpha$ of the arms 10' and 10", the pressing-down power required for pressing down the handle 9 is adapted to the power curve of the hand in the desired manner. An example of such an adaptation is shown in FIG. 1, in which the required pressing-down power in a stapler according to the invention, as shown, follows the power curve of the hand more closely than the required pressing-down power in the prior-art stapler described above. This adaptation results, as illustrated in FIG. 2, in a more uniform utilisation of the available hand power through the pivoting area of the handle 9. It should be noted that the degree of utilisation is not in any angular position of the handle 9 close to 100%, and that the degree of utilisation in the moment of firing ($v=v_1$), where high precision is desirable, is less than 50%.

It will be appreciated that the required pressingdown power can be varied still more by means of parameters other than the length and angle $\alpha$ of the arms 10' and 10".

The nose angle $\beta$ (see FIG. 4), i.e. the angle at the second arm front end engaging in the upper hole 16 of the driver 4, also affects the curve of the required pressing-down power. When the elbow lever element 10 is pivoted and displaced, the upwardly facing surface of the nose slides against the upper limiting wall of the upper hole 16, which is formed in the driver 4, thus causing an extra raising of the driver 4 depending on the nose angle $\beta$ in addition to the raising that is directly caused by the pivoting of the elbow lever element 10, if the upwardly facing surface of the nose is inclined obliquely upwards-backwards (see FIGS. 3 and 4). This extra raising in turn causes a supplementary tensioning of the leaf spring 5.

The course of the curve of the required pressingdown power can also be affected, for instance, by a suitable design of the support surface 15, which in the embodiment shown is horizontal but which can also be inclined or be curved.

According to an alternative embodiment, a support corresponding to the support surface 15 and intended for the pivot pin 14 consists of guiding grooves, which are arranged in the body 2 on both sides of the elbow lever element 10 for receiving one end each of the pivot pin 14.

While pivoting the handle 9 counterclockwise about the pivot pin 11, the elbow lever element 10 is moved forward by its first arm 10' being turnably connected to the handle by means of the turning pin 12. The first arm 10' can be connected to the handle 9 in some other manner. In a modified embodiment, the handle 9 abuts "loosely" against the first arm 10', which is then pressed against the underside of the handle by means of a spring. In this modified embodiment, the forward displacement of the elbow lever element 10 is carried out as the lever 9 is pressed downwards towards the body 2 by the second arm 10" being provided with laterally projecting pins, which engage in guiding grooves arranged in the body 2. In this modified embodiment, the handle 9 can be replaced by a handle which, like the handle 9, is turnably connected to the first arm 10' but which, in contrast to the handle 9, is not connected to the body 2 but is only supported by the elbow lever element 10 via the first arm 10'.

The invention can, of course, be used in other types of hand tools, in which an operating member corresponding to the driver of the stapler is tensioned against the action of a spring. Moreover, the invention can be used in certain types of hand tools, in which the displacement of the operating member is carried out against the action of a force, which is not produced by a spring but in some other manner. Mention can be made of, for instance, blind riveting tools.

I claim:

1. A hand tool comprising a body, a handle member pivotally mounted on said body, and an operating member which is displaceable between a starting position and a changeover position, the displacement of the operating member from the starting position to the changeover position, during use of the tool, taking place against the action of a force that increases during at least part of said displacement, and the handle member being arranged to engage the operating member so as to displace, when pivoting relative to the body, the operating member from the starting position to the changeover position, wherein the handle member comprises an elbow lever element, which has a pivot pin resting on a support arranged in the body and which is displaceable relative to the support transversely to an axis of the pivot pin, the elbow lever element having a first arm which is pivotable about the pivot pin toward and away from a portion of the body, and a second arm which is angled relative to the first arm and extends from the pivot pin toward the operating member to engage the operating member when the first arm pivots toward said portion of the body, and to move the operating member from the starting position to the changeover position against the action of said force, and wherein the handle member is arranged such that the pivot pin, when the first arm pivots toward said portion of the body, moves toward the operating member while the pivot pin rests on the support, whereby moment arms of the first and the second arms perpendicular to a direction of displacement of the operating member become longer and shorter, respectively.

2. The hand tool as claimed in clam 1, wherein the tool is a stapler for driving staples into an object, the operating member of the tool being a driving member which engages a spring member and is adapted, while moving from the starting position to the changeover position, to tension said spring member, which thus produces said force and which is adapted to impart to the driving member a striking motion starting from the changeover position in order to drive a staple into the object.

3. The hand tool as claimed in claim 1, wherein the operating member engages a spring member which is adapted to produce a force counteracting the displacement of the operating member from the starting position to the changeover position.

4. The hand tool as claimed in claim 1, wherein the handle member comprises a handle which is pivoted to the body, a pivot axis of the handle extending in parallel with the axis of the pivot pin of the elbow lever element, the first arm being connected to the handle so as to be pivoted by movement of the handle.

5. The hand tool as claimed in claim 4, wherein the first arm is turnably connected to the handle, a turning axis of the first arm extending in parallel with the axis of said pivot pin.

6. The hand tool as claimed in claim 2, wherein the handle member comprises a handle which is pivoted to the body, a pivot axis of the handle extending in parallel with the axis of the pivot pin of the elbow lever element, the first arm being connected to the handle so as to be pivoted by movement of the handle.

7. The hand tool as claimed in claim 6, wherein the first arm is turnably connected to the handle, a turning axis of the first arm extending in parallel with the axis of said pivot pin.

8. The hand tool as claimed in claim 3, wherein the handle member comprises a handle which is pivoted to the body, a pivot axis of the handle extending in parallel with the axis of the pivot pin of the elbow lever element, the first arm being connected to the handle so as to be pivoted by movement of the handle.

9. The hand tool as claimed in claim 8, wherein the first arm is turnably connected to the handle, a turning axis of the first arm extending in parallel with the axis of said pivot pin.

10. A hand tool comprising a body, a handle member pivotally mounted on said body, and an operating member which is displaceable between a starting position and a changeover position, the displacement of the operating member from the starting position to the changeover position, during use of the tool, taking place against the action of a force that increases during at least part of said displacement, and the handle member being arranged to engage the operating member so as to displace, when pivoting relative to the body, the operating member from the starting position to the changeover position, wherein the handle member comprises a lever element, which has a first portion resting on a support arranged in the body and a second portion which extends from said first portion toward the operating member to engage the operating member and which is rotatable about a point of engagement of said first portion with said support to move the operating member from the starting position to the changeover position against the action of said force, and wherein the handle member is arranged such that the second portion rotates about said point of engagement while said point of engagement moves toward the operating member, whereby a moment arm of the second portion perpendicular to a direction of displacement of the operating member becomes shorter.

11. The hand tool as claimed in claim 1, wherein the first and second arms are rigidly connected to each other.

12. The hand tool as claimed in claim 10, wherein the lever element is an elbow lever element and said second portion is an arm of said elbow lever element and the elbow lever element includes another arm extending from said first portion to said handle member.

13. The hand tool as claimed in claim 12, wherein the first portion rests on said support substantially at an elbow portion of the elbow lever element.

14. The hand tool as claimed in claim 13, wherein said arms of said elbow lever element are rigidly connected to each other.

15. The hand tool as claimed in claim 14, wherein said first portion includes a pin that rests on said support.

16. The hand tool as claimed in claim 13, wherein wherein said first portion includes a pin that rests on said support.

* * * * *